US010662747B2

(12) United States Patent
Di Renzo et al.

(10) Patent No.: US 10,662,747 B2
(45) **Date of Patent: *May 26, 2020**

(54) COAXIALLY ARRANGED MODE CONVERTERS

(71) Applicant: ENI S.P.A., Rome (IT)

(72) Inventors: Domenico Di Renzo, Casirate d'Adda (IT); Alberto Maliardi, San Donato Milanese (IT); Giovanni Galgani, Colle di Val d'Elsa (IT)

(73) Assignee: Eni S.P.A., Rome (IT)

( * ) Notice: Subject to any disclaimer, the term of this patent is extended or adjusted under 35 U.S.C. 154(b) by 46 days.

This patent is subject to a terminal disclaimer.

(21) Appl. No.: 15/502,927

(22) PCT Filed: Aug. 10, 2015

(86) PCT No.: PCT/IB2015/056067

§ 371 (c)(1),
(2) Date: Feb. 9, 2017

(87) PCT Pub. No.: WO2016/024198

PCT Pub. Date: Feb. 18, 2016

(65) Prior Publication Data

US 2017/0237145 A1 Aug. 17, 2017

(30) Foreign Application Priority Data

Aug. 11, 2014 (IT) ..... MI2014A1486

(51) Int. Cl.
*E21B 43/24* (2006.01)
*E21B 43/11* (2006.01)

(52) U.S. Cl.
CPC ..... *E21B 43/2401* (2013.01); *E21B 43/11* (2013.01)

(58) Field of Classification Search
CPC ..... E21B 43/2401
See application file for complete search history.

(56) References Cited

U.S. PATENT DOCUMENTS

| | | | | |
|---|---|---|---|---|
| 4,373,581 | A | 2/1983 | Toellner | |
| 4,485,869 | A | 12/1984 | Sresty et al. | |
| 4,508,168 | A | 4/1985 | Heeren | |
| 5,293,936 | A * | 3/1994 | Bridges | E21B 36/04 166/248 |
| 7,441,597 | B2 | 10/2008 | Kasevich | |
| 7,891,421 | B2 | 2/2011 | Kasevich | |
| 8,371,371 | B2 | 2/2013 | Diehl et al. | |

(Continued)

FOREIGN PATENT DOCUMENTS

| | | | |
|---|---|---|---|
| WO | 2009027305 | A2 | 3/2009 |
| WO | 2009043055 | A2 | 4/2009 |

(Continued)

OTHER PUBLICATIONS

International Search Report for PCT/IB2015/056067 dated Apr. 15, 2016, 13 pgs.

(Continued)

*Primary Examiner* — D. Andrews
(74) *Attorney, Agent, or Firm* — Praedcere Law

(57) ABSTRACT

The present invention relates to a device for generating a disturbance in the differential mode of propagation of an RF signal transmitted along a coaxial transmission line.

7 Claims, 3 Drawing Sheets

(56) References Cited

U.S. PATENT DOCUMENTS

| | | | |
|---|---|---|---|
| 8,453,739 | B2 | 6/2013 | Parsche |
| 8,646,527 | B2 | 2/2014 | Trautman et al. |
| 8,766,146 | B2 | 7/2014 | Diehl |
| 2010/0219107 | A1 | 9/2010 | Parsche |
| 2012/0061080 | A1 | 3/2012 | Sultenfuss et al. |
| 2012/0061380 | A1 | 3/2012 | Parsche |
| 2012/0061383 | A1 | 3/2012 | Parsche |
| 2012/0090844 | A1 | 4/2012 | Madison et al. |
| 2013/0284430 | A1 | 10/2013 | Parsche |
| 2013/0334205 | A1 | 12/2013 | Wright et al. |
| 2014/0216714 | A1 | 8/2014 | Dittmer et al. |
| 2014/0216724 | A1 | 8/2014 | Dittmer |
| 2014/0301017 | A1 | 10/2014 | Diehl et al. |
| 2015/0279571 | A1 | 10/2015 | Diehl |

FOREIGN PATENT DOCUMENTS

| | | | |
|---|---|---|---|
| WO | 2009109489 | A1 | 9/2009 |
| WO | 2012067769 | A2 | 5/2012 |
| WO | 2013060610 | A1 | 5/2013 |
| WO | 2014048593 | A2 | 4/2014 |
| WO | 2016024197 | A2 | 2/2016 |
| WO | 2016024198 | A2 | 2/2016 |

OTHER PUBLICATIONS

Matteo Bientinesi et al., 'A radio frequency/microwave heating method for thermal heavy oil recovery based on a novel tight-shell conceptual design,' Journal of Petrolleum Science and Engineering 107 (2013) pp. 18-30, Italy.

International Search Report for PCT/IB2015/056066 dated Mar. 16, 2016, 11 pgs.

* cited by examiner

COAXIALLY ARRANGED MODE CONVERTERS

FIELD OF THE INVENTION

The present invention relates to a device for generating a disturbance in the differential mode of propagation of an RF (radio frequency) signal transmitted along a coaxial transmission line.

In particular, a device of this kind is used in a system for the in-situ heating of high-viscosity hydrocarbons by means of RF radiation, particularly a system for creating disturbance along an antenna comprising a coaxial array made up of mode converters, more particularly an RF system comprising a coaxial array of mode converters, inserted in a system for the distributed heating of high-viscosity oils.

PRIOR ART

The device of the present invention may be used where there is a need to generate a disturbance in the differential mode of propagation of an RF signal transmitted along a coaxial transmission line.

In particular, the device of the present invention is used in the area of extracting hydrocarbons by means of heating the hydrocarbons themselves by means of RF. In the prior art in this field patent applications or already published patents disclose methods and systems for the application of RF heating within oil wells. These documents generally describe apparatus comprising generators of RF energy installed at the surface, transmission lines for transporting the RF signal to the base of the well and constructions (antennas) for irradiating or applying RF energy to the geological formation.

Some patent reference documents describe possible methods for oil production which can be achieved by means of RF heating in situ, in particular:

- Reducing the viscosity of heavy oils (U.S. Pat. No. 7,891,421 Method and apparatus for in-situ RF heating Kasevich (2011)),
- Liquefaction of solid hydrocarbons in reservoir conditions (tar sands) U.S. 2012/0090844 Simultaneous Conversion and recovery of bitumen using RF Madison et al. (2012))
- Production of oil by high-temperature pyrolysis of kerogens (in oil shale) (U.S. Pat. No. 4,485,869 Recovery of liquid hydrocarbons from oil shale by electromagnetic heating in situ Sresty et at. (1984))
- Production of organic products from oil shale (U.S. Pat. No. 4,508,168 RF applicator for in situ heating Heeren (1985))
- In-situ conversion (upgrading) by means of heating heavy oils to high temperature (with or without the introduction of materials, catalytic beds and/or other reactive substances) (U.S. 2010/0219107 Radio Frequency Heating of petroleum ore by particle susceptors Parsche (2010); U.S. Pat. No. 7,441,597 Method and apparatus for in-situ RF assisted gravity drainage of oil Kasevich (2008))
- Methods for injecting steam assisted by RF heating (U.S. 2012/0061080 Inline RF heating for SAGD operations Sultenfuss et al. (2012); U.S. Pat. No. 8,646,527 RF enhanced SAGD method for recovery of hydrocarbons Trautman et al. (2014))

Further, there are patent reference documents relating to different types of antennas or applicators for wells:

- Antennas, whether dipole, helical, solenoid or collinear (U.S. Pat. No. 7,441,597 Method and apparatus for in-situ RF assisted gravity drainage of oil Kasevich (2008); U.S. 2012/0061380 Apparatus and method for heating of hydrocarbon deposits by RF driven coaxial sleeve Parsche (2012));
- Electrode arrays (U.S. Pat. No. 4,485,869 Recovery of liquid hydrocarbons from oil shale by electromagnetic heating in-situ Sresty et al. (1984));
- Two-wire transmission lines folded back on themselves to form elongated loops (U.S. 2012/0061383 Litz Heating Antenna Parsche (2012));
- Triaxial transmission lines and sleeves (U.S. Pat. No. 8,453,739 Triaxial linear induction antenna array for increased heavy oil recovery Parsche (2013); U.S. 2013/0334205 Subterranean antenna including antenna element and coaxial line therein and related methods Wright et al. (2013)).

Some of these references (U.S. Pat. No. 7,441,597; U.S. 2012/0061380) describe wire antennas of the resonant type. These types of antenna are generally limited to a length of a few metres and allow a limited portion of the reservoir around the antenna to be heated to high temperature. Systems having antennas of this kind could provide effective solutions for oil sands. Antennas of this kind are obtained by installing within the well ad-hoc metal constructions, or in some cases making use of the completion elements themselves. Other systems (as described for example in U.S. Pat. No. 4,485,869) are based on arrays of electrodes installed in holes in the ground for forming a condenser construction. In these systems, heating is achieved inside the volume of the ground delimited by the electrodes. These systems have been proposed for the recovery of hydrocarbons in oil shale outcrops.

Finally, other systems proposed for application to oil sands are based on triaxial or elongated loop constructions for installations inside horizontal wells (U.S. 2013/0334205, U.S. Pat. No. 8,453,739, U.S. 2012/0061383). These antenna systems, which are supplied at relatively low frequency (in the range of 1-10 kHz) and power in the order of several MW, are proposed for heating that is distributed along a horizontal well to the high temperatures required for liquefaction of solid bitumen.

The systems of the prior art have limitations and practical disadvantages, as summarised below.

The resonant antennas of the concentrated type are not effective with horizontal wells having very long drains (for example having a length in the order of hundreds of metres). This is because resonant antennas cannot be effective in distributing radiation along the well, even if they have lengths typical of the drains concerned. For example, a dipole 1000 m long which is supplied from the centre and which irradiates within a dispersive medium (a typical range for the electrical conductivity of oil reservoirs is between 0.001 and 0.1 S/m) distributes an electrical field that is limited to a few metres around the supply point, regardless of the physical length of the dipole.

This performance is also characteristic of other types of resonant antenna having geometric structures different from those of a dipole, such as helical, solenoid or collinear with a coaxial sleeve dipole. Thus, it is not possible to utilise this class of antenna to distribute energy along the drain.

Distributed antennas, which are designed to work at frequencies of 1-10 kHz, have other disadvantages, however. The parameters of triaxial antennas do not allow the configuration or design of the radiating array to be a function of the characteristics of the surrounding medium or of the desired distribution of energy along the drain. In particular, the way RF power may be distributed uniformly along the drain is not defined.

Furthermore, triaxial antennas may be very bulky constructions, given the need for sleeve constructions surrounding the transmission line. This last aspect may constitute a disadvantage for incorporating antennas into oil wells.

Two-wire line antennas folded back on themselves to form elongated loops have other disadvantages, however. The first of these arises from the fact that the two-wire line has high losses when transferring energy. This could result in a marked loss of energy inside the oil well, which is disadvantageous for the transfer of energy deep within the reservoir. Furthermore, and similarly to triaxial antennas, it is not clear how the distribution of power transferred to the medium may be controlled. It seems that the only parameter determining the radiant properties of the construction is the distance between the two conductors of the two-wire line, which is in any case limited to the section inside the well in which it is installed.

The proposed antennas having frequencies of 1-10 kHz have other disadvantages. Antennas of this kind operate in frequency ranges in which the distribution of electromagnetic energy in the radial direction (relative to the axis of the well) cannot be controlled by controlling the frequency. This is because in the range of 1-10 kHz, the skin depth (the depth at which the emf penetrates the medium, equal to $d=\mathrm{sqrt}(2/(s\omega\mu))$, where s is electrical conductivity, $\omega$ is the angular frequency of the emf, and $\mu$ is magnetic permeability) is much greater than the heating ray concerned (which could generally be in the order of 10-15 m). As s=0.01 S/m, the skin depth will in fact be in the order of 50-160 m for frequencies of between 10 and 1 kHz.

It follows that the heating range coincides with close range ($r \ll d$), in which the distribution of the emf in the radial direction does not depend on frequency.

At higher frequencies, however, skin depth values are comparable with the heating ray (for example a skin depth is 1.5-5 m at frequencies of 10-1 MHz). This may be utilised to the benefit of thermal recovery, since it allows the distribution of energy deep in the medium (in the radial direction) to be regulated by the selection of frequency, which may thus be utilised to regulate the temperature range in the radial direction. Regulation of the temperature range may be utilised to maximise the mobility of the oil in the rock and to increase the well's productivity.

OBJECT OF THE PRESENT INVENTION

The object of the present patent application is to provide a technology that overcomes, at least in part, the disadvantages of the systems that are currently available.

GENERAL STATEMENT OF THE INVENTION

The present invention relates to a device for generating a disturbance in the differential mode of propagation of an RF signal transmitted along a coaxial transmission line, the line including an external conductor and an internal conductor which are separated by a layer of dielectric material, the device including: a first conductor; a second conductor; connection means which are suitable for forming an electrical connection between the device and the coaxial transmission line such that the first conductor of the device forms an electrical connection between the external conductor of the transmission line upstream of the device and the external conductor of the transmission line downstream of the device, and the second conductor of the converter forms an electrical connection between the internal conductor of the transmission line upstream of the device and the internal conductor of the transmission line downstream of the device; wherein, in the presence of an RF signal along the coaxial transmission line, a disturbance in the differential mode of propagation of the signal along the coaxial transmission line is generated, inducing a current in the external conductor of the coaxial transmission line and an electromagnetic field in the area surrounding the coaxial transmission line.

In a preferred embodiment of the present invention, a device of this kind creates inductive elements along the coaxial line which cause the disturbance in the differential mode of propagation which is advantageous for the common mode of irradiation.

In a further embodiment of the present invention, a device of this kind creates either capacitive or both inductive and capacitive elements to disturb the differential mode of propagation.

A system of converters of this kind allows, by means of a particular type of antenna (as for example that described in the application filed in parallel by the same applicant), the distribution of RF radiation along the drain of oil wells and the provision of uniform and controlled heating of a reservoir portion within the producing well. Uniform heating represents the key aspect in increasing the productivity of heavy oil wells.

The present invention relates to the electrical constructions formed by the mode converters, which are to be used for example to form the antenna array.

The importance of heavy oils as an energy resource is growing continuously as a result of the development of advanced methods of recovering oil, such as thermal recovery. Heating the reservoir by means of radio frequency using a system comprising the antenna located in a bore hole may be a valid alternative to traditional steam injection methods, providing advantages such as good energy distribution, less dependence on the properties of the reservoir, compact equipment, a high level of efficiency and ways of concentrating the energy in the oil phase. Irradiated radio frequency (RF) may thus be a valid alternative to the thermal recovery of heavy oil, since it is less sensitive to the geological formation and is capable of distributing the heat over a large volume of the reservoir.

Patent applications or already published patents disclose methods and systems for the application of RF heat within oil wells. These documents generally describe apparatus comprising generators of RF energy installed at the surface, transmission lines for transporting the RF signal to the base of the well and constructions (antennas) for irradiating and/or applying RF energy to the geological formation.

According to a preferred embodiment of the present invention, the use of coaxially arranged mode converters for RF heating in oil wells provides various advantages, including the possibility of distributing the RF energy over long drain sections, providing uniform RF heating of long drain sections, adapting the radiation behaviour of an array of this kind as a function of the electromagnetic characteristics of the surrounding medium, and forming an antenna of limited bulk for installation in producing wells.

The systems according to the present invention enable the formation of a distributed antenna having electromagnetic performance (total radiation efficiency, profile of distribution of radiation along the drain and return loss) suitable for the possible applications.

BRIEF DESCRIPTION OF THE DRAWINGS

Reference will now be made to a series of drawings to facilitate the description of some preferred embodiments of the present invention.

DETAILED DESCRIPTION OF A PREFERRED EMBODIMENT

Figure 1:
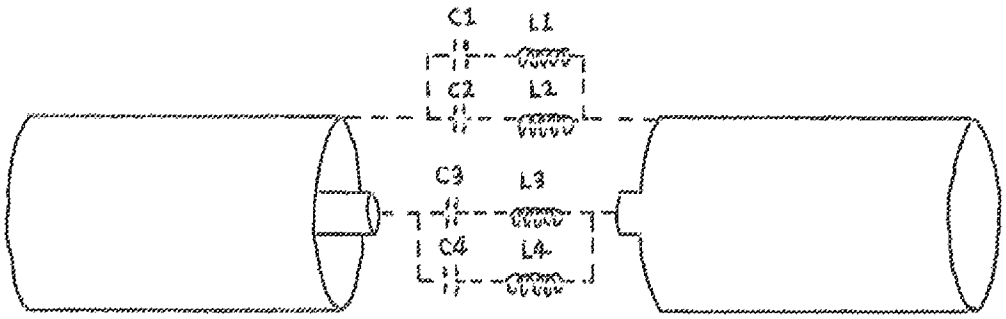
FIG. 1 shows a mode converter according to an embodiment of the present invention.

According to an embodiment of the present invention, the device includes electrical constructions which may be used as mode converters for the formation of the RF antenna in the well. A system for heating the wells by means of a coaxial antenna to which the (one or more) devices according to the present invention may be applied is for example described in the patent application filed, in parallel with the present one, by the same applicant.

The system operates by applying power in the order of 100-1000 kW at frequencies in the range of 0.1-10 MHz. An embodiment according to these parameters may be advantageous in achieving moderate heating along a drain in the order of several hundred metres in length, such as 1000 m or more. An embodiment of this kind may increase the productivity of a heavy oil well to a significant extent, at the same time ensuring a limited expenditure of energy per barrel of oil produced. In an embodiment of this kind, the increase in temperature may be 50° C. at the well, 28° C. five metres away from the well in the radial direction, 13° C. ten metres away and 10° C. fifteen metres away. In a further embodiment, the system operates at frequencies of 0.1 -10 MHz and is used to recover heavy oils.

The system may furthermore be suitable, by way of the design of the array parameters, for different reservoirs and for achieving the desired distribution of RF radiation along the well.

The system is thus characterised by the ability to irradiate along the drain at the frequencies concerned in controlled manner.

Particularly advantageous is the configuration in which irradiation is uniform, or rather the power irradiated from each mode converter is constant along the drain.

According to a possible configuration of the system for heating by means of RF radiation output by a coaxial antenna equipped with mode converters, the system includes an RF generator, a well perforator, a coaxial RF connection, and one or more (e.g. a coaxial array of) mode converters according to a preferred embodiment of the present invention. The RF generator is advantageously installed at the surface and operates within the range of frequencies of 0.1-10 MHz. In some embodiments, the generator may deliver power <1 MW to achieve moderate heating, if this is sufficient to reduce the viscosity of the heavy oils to a significant extent. In other embodiments, the power may be >=1 MW, if there is a requirement to reach high temperatures over a distance of several metres from the well in order to mobilise the hydrocarbon.

There are various ways to construct a high-power RF generator in the range of frequencies concerned. The transmitter may take the form of an array of solid state amplifiers, of vacuum tubes or of hybrid solutions combining the two.

The transmitter may also comprise an inverter. The generator may also incorporate an impedance adapter unit which adapts the output from the transmitter to the load in order to maximise the transfer of power to the medium. The generator output is connected to the well head by means of a coaxial cable.

The wellhead perforator according to the system described in the above-mentioned parallel patent application to the present one is the part of the system that enables the signal to be transmitted from the surface to the inside of the well by way of a construction integrated in the equipment at the well head. The two ends of the perforator are connected to the coaxial cable coming from the generator and the coaxial cable installed inside the well for the transmission of power to the base of the well.

The wellhead perforator is normally coaxial in construction or has a two-wire construction. Any electrical construction which gives limited insertion loss and return loss values may be used to form the perforator.

The coaxial transmission line at the base of the well is the construction allowing the signal to be transported to the base of the well, or to the antenna input. Different types of construction may be used to form the coaxial cable.

The coaxial cable must ensure characteristics that are appropriate for the distance over which power is to be transferred, in respect of both peak power and average power, and low attenuation of the signal, in order to be able to transfer the desired power to the base of the well continuously and to supply a high level of energy efficiency.

These characteristics improve as the diameter of the cable increases. To this end, the coaxial cable must be dimensioned with sections of external conductor (braid) and internal conductor (core) large enough to transfer the power over the desired distance. The characteristics of the coaxial cable also depend on the dielectric material separating the internal conductor from the external one. The use of materials with low dielectric losses enables the distance over which the cable can transfer power and the efficiency to be increased. Materials that can be used to form a cable suitable for the application are for example PTFE (polytetrafluoroethylene) and expanded PTFE, which have low losses. Other dielectric materials may also advantageously be used to form the coaxial cable. The antenna comprising a coaxial array of mode converters has a length compatible with that of the drain, or with a relevant proportion of the drain (e.g. 30%, 50% or 70%). The length of the antenna thus depends on the length of the drain and may thus vary with the type of well and reservoir. For horizontal wells, a typical drain length may be 1000 m. Lengths of drain and substantial sections of bore hole may also be found in vertical or slant wells that intersect very thick reservoirs (for example drain lengths of 100 m in vertical wells).

In such contexts, the antenna comprising the array of mode converters may be designed and used to heat the reservoir over the entire extent of the drain of the vertical or slant well.

The mode converters are electrical constructions which are connected to one another along the coaxial cable. The particular construction of the mode converters has the function of disturbing the differential mode of propagation of the RF signal along the cable. Disturbance of the propagation mode sets up a common mode. This produces currents that flow outside the coaxial cable in a coaxial section that is centred on the point where the mode converter is installed. An emf is associated with such external currents in the surrounding area, and this heats the geological formation.

This mechanism transfers a proportion of the power transferred along the coaxial cable to the outside.

The use of an array of mode converters positioned along the coaxial line allows a considerable proportion or all of the power supplied to the coaxial cable to be transferred. The mode converters may be of the inductive type. Inductance may be brought about by the geometric structure of one of the two conductors or both the conductors. Inductance may be brought about by combining the geometric structure of the conductors with the use of materials of high magnetic susceptibility.

As an alternative, the converters may be of the capacitive type. Capacitance may be brought about by the geometric structure of one of the two conductors or both the conductors. Capacitance may be brought about by combining the geometric structure of the conductors with the use of materials of high dielectric permittivity.

The converters may also be of the inductive-capacitive type. Converters of this kind are characterised by combinations of constructions described above.

The inductance and/or capacitance values brought about by a mode converter are selected at the design stage of the antenna and depend on the electromagnetic characteristics of the reservoir, the electromagnetic characteristics of the fluids inside the well and any antenna coverings, and the efficiency of radiation sought for the particular mode converter.

In the case of a plurality of converters forming an array, the individual mode converters may have different structural characteristics from one another. In particular, the mode converters positioned at the beginning of the array must be designed to supply low radiation efficiency, that is to say to irradiate a limited proportion of the power that is input, and allow a substantial proportion of the power to be transmitted downstream. The mode converters positioned at the end of the array, by contrast, must supply a high radiation efficiency to irradiate a substantial proportion of the remaining power.

As illustrated in FIG. 1, the mode converter has at least two conductors: the first conductor connects the braid of the coaxial cable upstream of the device to the braid of the coaxial cable downstream of the device, and the second conductor connects the core of the coaxial cable upstream of the device to the core of the coaxial cable downstream of the device. The geometric shape adopted by these two conductors is such that inductive and/or capacitive elements are created along the transmission line. FIG. 1 shows an embodiment in which each of the two conductors creates four different elements, two inductive and two capacitive (for the external conductor these are C1, C2, L1 and L2; for the internal conductor these elements are C3, C4, L3 and L4). As shown in the figure, such elements may be connected to one another in series and/or in parallel in order to bring about equivalent inductance and capacitance values as desired for the application. The construction shown in FIG. 1 is an exemplary embodiment in which a plurality of inductive and capacitive elements are used within a single mode converter. In practice, a mode converter may advantageously be formed using only some of the inductive and capacitive elements shown in FIG. 1.

Figure 2:
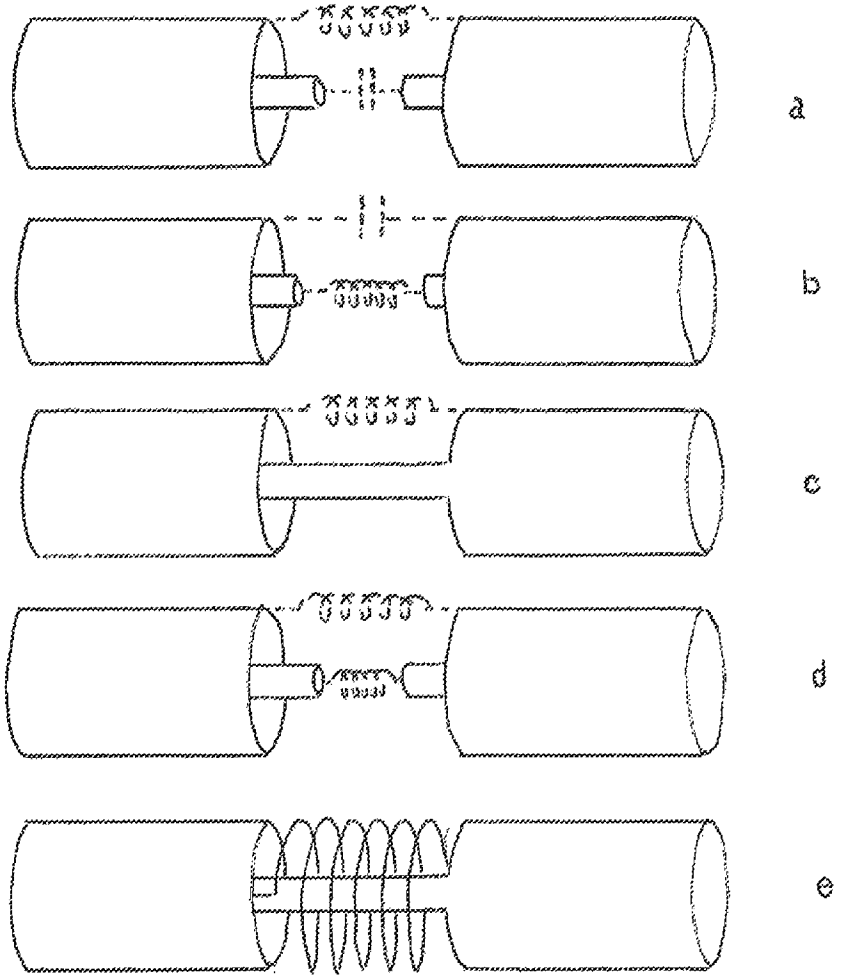
FIG. 2 shows some alternative embodiments of a mode converter.

FIG. 2 shows some exemplary embodiments of mode converters derived from that shown in FIG. 1, where only some elements are selected.

In particular, FIG. 2*a* shows a mode converter of the inductive-capacitive type in which the external conductor is wound to form a coil structure which creates an inductance parameter, and the internal conductor is interrupted by a pair of plates which create a capacitance parameter; FIG. 2*b* shows a mode converter of the inductive-capacitive type in which the external conductor is interrupted by a pair of plates which create a capacitance parameter, and the internal conductor is wound to form a coil structure which creates an inductance parameter. FIG. 2*c*, by contrast, shows a mode converter of the inductive type in which the external conductor is wound to form a coil structure which creates an inductance parameter, and the internal conductor forms a direct link from the core of the coaxial cable upstream to the core of the coaxial cable downstream. FIG. 2*d*, by contrast, shows a mode converter of the inductive type in which the external conductor is wound to form a coil structure which creates an inductance parameter, and the internal conductor, like the external one, is also wound to form a coil structure which creates an inductance parameter; finally, FIG. 2*e* shows a mode converter of the inductive type in which the external conductor is wound to form a coil that is coaxial in relation to the internal conductor and in which, unlike the structures above, coils are positioned laterally in relation to the internal conductor.

Figure 3:
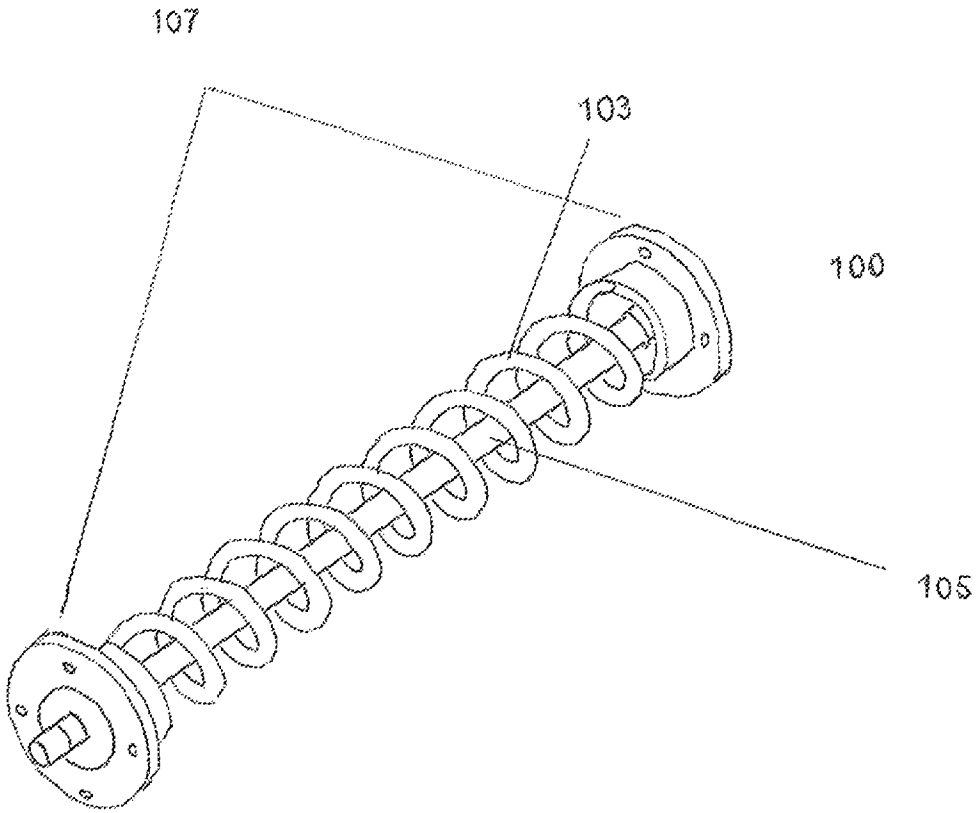
FIG. 3 shows a mode converter according to an embodiment of the present invention with an example of connection interfaces with the coaxial line.

As illustrated in FIG. 3, the mode converter 100 has, according to a preferred embodiment of the present invention, at least two conductors 103 and 105. The mode converter is joined into a coaxial transmission line (also called the antenna) that is connected to a generator and suitable for transmitting the signal along the drain, the coaxial line including an external conductor (also called the braid) and an internal conductor (also called the core) which are separated by a layer of dielectric material. The first conductor 103 of the mode converter connects the braid of the coaxial section upstream of the line to the braid of the coaxial section downstream of the line. The second conductor 105 connects the core of the coaxial section upstream of the line to the core of the coaxial section downstream of the line.

The mode converter may be connected to the coaxial cable by means of appropriate connectors, which may be of the coaxial or two-wire type. According to a preferred embodiment, as illustrated in FIG. 3, a connector 107 of the coaxial type ensures there is a connection between the mode converter 100 and the coaxial transmission line. The converter shown in FIG. 3 is of the inductive type, in which a central conductor 105 connects the core of the coaxial section upstream to the core of the coaxial section downstream and a coil conductor 103 of the coaxial type relative to the central conductor connects the braid of the coaxial section upstream to the braid of the coaxial section downstream.

The invention claimed is:

1. A device for generating a disturbance in the differential mode of propagation of an RF signal transmitted along a coaxial transmission line, the coaxial transmission line including an external braided conductor and an internal core conductor which are separated by a layer of dielectric material, the device including:

a first external conductor;

a second internal conductor;

connection means for forming an electrical connection between the device and the coaxial transmission line such that said first conductor of said device forms an electrical connection in an axial space between the external braided conductor of the coaxial transmission line upstream of said device and the external braided conductor of the coaxial transmission line downstream of said device, wherein said second conductor of said device forms an electrical connection axially between the internal core conductor of the coaxial transmission line upstream of said device and the internal core conductor of the coaxial transmission line downstream of said device;

wherein said first conductor comprises at least one of an inductive element and a capacitive element and said second conductor comprises at least one of an inductive element, a capacitive element and said internal core conductor;

wherein said device lacks a sleeve along said axial space;

wherein, in the presence of an RF signal along the coaxial transmission line, a disturbance in the differential mode of propagation of the signal along the coaxial transmission line is generated, inducing a current in the external braided conductor of the coaxial transmission line and an electromagnetic field in the area surrounding the coaxial transmission line.

2. The device according to claim 1, in which said first conductor includes only said inductive element.

3. The device according to claim 1, in which said first conductor includes only said capacitive element.

4. The device according to claim 1, in which said second conductor includes only said inductive element.

5. The device according to claim 1, wherein said second conductor includes only said capacitive element.

6. A system for facilitating the extraction of hydrocarbons by RF heating of high-viscosity hydrocarbons in situ by means of a coaxial transmission line and the device according to claim 1 arranged as a plurality of said devices disposed in series for at least 100 meters along said coaxial transmission line.

7. An array comprising a plurality of said devices of claim 1, constructed and arranged in an antenna adapted for use in a system for facilitating the extraction of hydrocarbons by RF heating of high-viscosity oils in situ.

* * * * *